US005293521A

United States Patent [19]

Blanchard et al.

[11] Patent Number: 5,293,521

[45] Date of Patent: Mar. 8, 1994

[54] PROTECTIVE RELAY SWITCH HAVING TRAP DOOR

[75] Inventors: Christian Blanchard, Rueil Malmaison; Michel Lauraire, Courbevoie; Didier Vigouroux, Jouy-le-Moutier, all of France

[73] Assignee: Telemecanique, Rueil Malmaison, France

[21] Appl. No.: 992,011

[22] Filed: Dec. 17, 1992

[30] Foreign Application Priority Data

Dec. 17, 1991 [FR] France ..... 91 15766

[51] Int. Cl.[5] ..... H01H 67/02

[52] U.S. Cl. ..... 335/132; 335/202

[58] Field of Search ..... 335/6, 27, 131-132, 335/202

[56] References Cited

U.S. PATENT DOCUMENTS 4,037,184 7/1977 Kimpesty et al. .

FOREIGN PATENT DOCUMENTS 0366519 5/1990 European Pat. Off. .
255208 3/1912 Fed. Rep. of Germany .
2719053 7/1977 Fed. Rep. of Germany .

*Primary Examiner*—Lincoln Donovan
*Attorney, Agent, or Firm*—Oblon, Spivak, McClelland, Maier & Neustadt

[57] ABSTRACT

A protective switch device such as a relay switch is provided with at least one pole having contacts that can be separated. It includes a control mechanism (5) that can cause the opening and closing of contacts (21, 31) and that can be actuated by a protective device (4) that can act in case of electrical failure, and a manual control button (6) controlling an electromagnet (7) for operating the contacts. A moving trap door (11) opens and closes an opening of the box so as to make it possible to change the coil of electromagnet (7). The trap door (11) cooperates with a trap door locking element (81) that can be displaced between a closed position where it immobilizes the trap door on the box and an open position making it possible to open the trap door. The trap door locking element (81) is associated with a selective blocking element (82, 62) able to immobilize it in closed position when manual control button (6) occupies all positions other than the stop position and to free it so that a user can bring it into open position, making it possible to open the trap door, when manual control button (6) occupies the stop position.

4 Claims, 2 Drawing Sheets

PROTECTIVE RELAY SWITCH HAVING TRAP DOOR

BACKGROUND OF THE INVENTION

1. Field of the Invention

This invention relates to a protective switch device such as a relay switch, provided with at least one pole having contacts that can be separated by either a control mechanism that can cause the opening and closing of the contacts and that can be actuated by protective means that can act in case of electrical failure, or an electromagnet controlled by a manual control button.

2. Description of the Related Art

Devices of the above type, called relay switches, are known to integrate into the same box a current limiting, resettable circuit breaker for protection against short circuits and a contactor for automatic control and remote control. In addition, these devices integrate a magnetic-thermal protection that can cause the opening of the contacts in case of overload or excess current.

The user of such a device can replace the coil of the electromagnet which is housed in the box, for example to change its voltage utilization. Safeties are provided to perform this operation. The replacement of the coil of the electromagnet can be performed only after having removed the wires going to the terminals of the coil. After this operation, it is possible to remove a cover providing access to the electromagnet and to replace it. These disassembly and reassembly operations are relatively complicated.

SUMMARY OF THE INVENTION

This invention has as an object to provide a device of the relay switch type in which the disassembly and reassembly necessary for changing the coil of the electromagnet are simplified as much as possible.

A further object of the invention is to assure the safety of the operation without it being necessary to disconnect the wires from the connecting terminals of the coil.

According to the invention, the device comprises a moving trap door that opens and closes an opening of the box so as to make it possible to change the coil of the electromagnet. This trap door cooperates with a trap door locking element that can be displaced between a closed position where it immobilizes the trap door on the box and an open position making it possible to open the trap door. This trap door locking element is associated with selective blocking means able to immobilize it in closed position when the manual control button occupies all positions other than the stop position and to free it so that a user can bring it into open position, making it possible to open the trap door, when the manual control button occupies the stop position.

According to a further feature of the invention, the trap door locking element consists of sliding bolt that is mobile in translation parallel to the axis of the control button and a blocking slide that prevents any displacement of this sliding bolt when the control button occupies a position other than the stop position and is able to enter the control button when the latter is in stop position so as to free the movement of the sliding bolt.

According to a further feature, the control button exhibits a shape that makes possible the displacement of the blocking slide, in stop position of the device.

According to a further feature, the trap door sliding bolt swings around an axis and carries blocking means that cooperate with the manual control button.

BRIEF DESCRIPTION OF THE DRAWINGS

The invention will now be described with more detail by referring to an embodiment given by way of example and represented by the accompanying drawings in which.

DETAILED DESCRIPTION OF THE PREFERRED EMBODIMENTS

Figure 1:
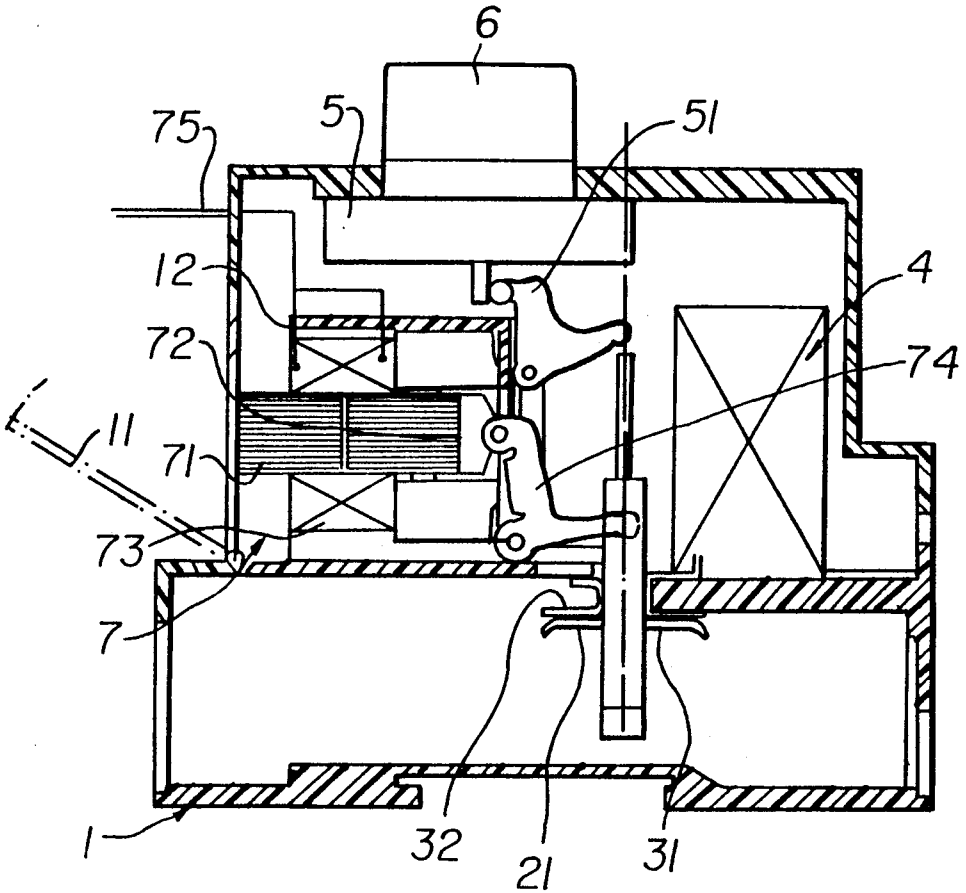
FIG. 1 diagrammatically shows in elevation a protective device of the relay switch type according to the invention.

The relay switch type device illustrated by FIG. 1 comprises, in a box 1, several cutoff poles of the double breaker type. Each pole comprises a moving contact bridge 21 which cooperates via contact chips with two stationary contacts 31, 32 connected to connecting terminals to establish or interrupt the passage of a current between these terminals.

A unit 4 for magnetic and thermal protection is placed in each current path in the box. When unit 4 detects an excess current in the current path, it causes a mechanism 5 equipped with a lever 51 to move a contact carrier 2 that supports the contact bridges 21, thereby moving the bridges so as to separate from the stationary contacts. Unit 4 includes, for example, a magnetic trigger and a thermal trigger.

On the other hand, an electromagnet 7 housed in box 1 acts on another part of contact carrier 2. The electromagnet comprises a stationary magnetic circuit 71, a movable armature 72 and a coil 73 connected electrically to terminals by a switch; the latter can be controlled by mechanism 5 and/or by a button 6 that can control the electromagnet such that the electromagnet cannot be activated when the button 6 is rotated to a stop position. Movable armature 72 of the electromagnet is subject to a return spring and cooperates with a lever 74 which is directly coupled to contact carrier 2.

The box has, on the side of electromagnet 7, an opening 12 making it possible to insert and to remove the electromagnet coil which is housed in a housing of the box. This opening is closed by a movable trap door 11. The movement of opening and closing trap door 11 does not require any disconnection of coil power supply wires 75. Preferably, trap door 11 can pivot on the box like a flap or a door.

A trap door sliding bolt 81 is mounted in box 1 such that it can be displaced between a closed position (FIG. 2) corresponding to the closed position of the trap door and an open position (FIG. 3) making it possible to open the trap door. In the closed position of FIG. 2 the sliding bolt engages a recess in the trap door 11 and prevents its opening.

Figure 2:
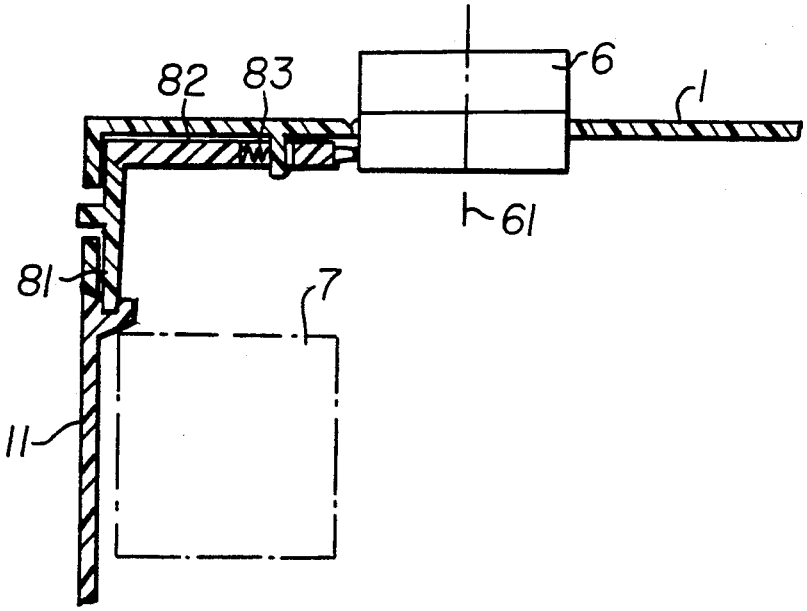
FIG. 2 is a detail view of the mechanism for changing the electromagnet coil of the device of FIG. 1, shown in operating position.
Figure 3:
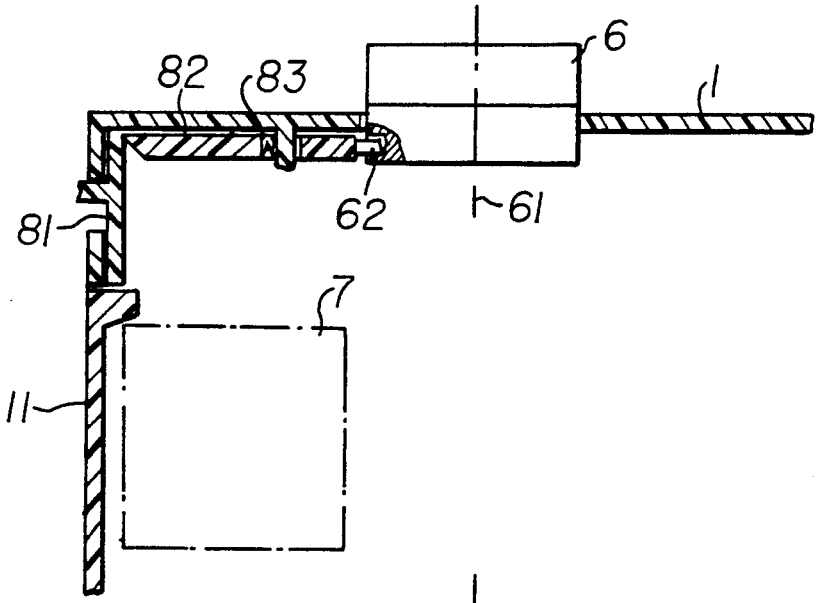
FIG. 3 is another view of the mechanism of FIG. 2, with the blocking mechanism in the stop position, making possible the changing of the coil.

The trap door sliding bolt 81 is associated with a blocking mechanism 82 able to keep it immobilized in the closed position of FIG. 2 when manual control button 6 occupies all positions other than the stop position of FIG. 3, and to free it, so that a user can open the trap door, when manual control button 6 occupies the stop position.

In the embodiment of FIGS. 2 and 3, trap door sliding bolt 81 is movable in translation parallel to the axis of rotation 61 of button 6 and cooperates with a blocking slide 82 that is movable in translation, perpendicular to axis 61 and to the direction of translation of sliding bolt 81. This slide 82 is biased by a return spring 83 that tends to bring it back into a position blocking sliding bolt 81. When control button 6 occupies a position other than the stop position, slide 82 is prevented from being displaced and blocks any displacement of sliding bolt 81 from the closed position. Manual control button 6 has a shape that makes possible the displacement of blocking slide 8 when it is in the stop position. For this purpose, control button 6 has a blind hole 62 with an opening in which the end of blocking slide 82 can be engaged. This blind hole 62 is positioned opposite slide 82 only when manual control button 6 is in the stop position of FIG. 3.

Figure 4:
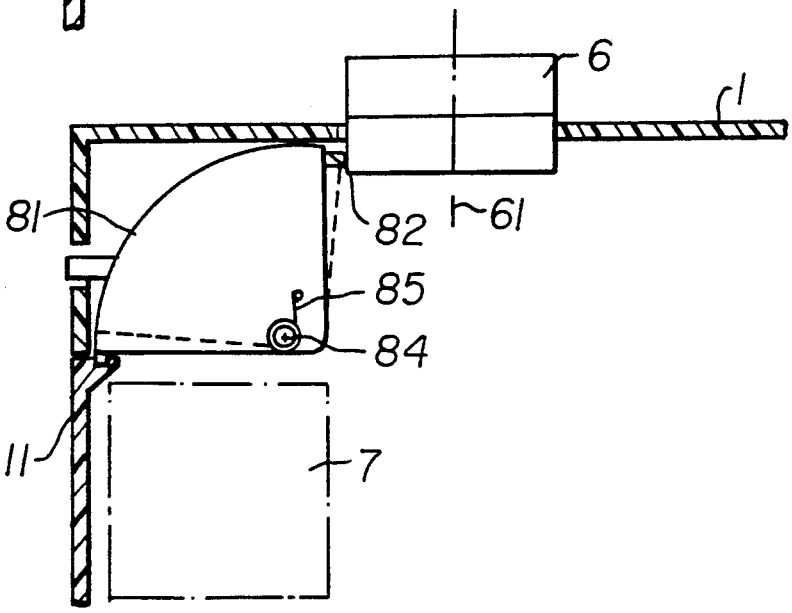
FIG. 4 is a detail view of a second embodiment of the mechanism for changing the electromagnet coil according to the invention.

In the embodiment of FIG. 4, trap door sliding bolt 81 is mounted to rotate on the box around an axis 84 and is subject to biasing by a return spring 85. This sector-shaped sliding bolt can swing between a closed position shown in solid lines and an open position shown in dotted lines. It carries a blocking pin 82 preventing any rotation of this sliding bolt 81 to the open position when button 6 occupies a position other than the stop position. In the stop position of control button 6, a blind hole made in this button, similar to blind hole 62, makes possible the rotating of sliding bolt 81 up to the open position.

The operation will now be explained.

In the illustrated position, control button 6 prevents any displacement of sliding bolt 81 and, consequently, any opening of the trap door.

In the stop position of the control button 6, control button 6 permits the displacement of the sliding bolt 81 for opening the trap door. The user can therefore displace the sliding bolt and open the trap door to change the coil.

Since the control button 6 must be in the stop position for the trap door to be opened, the device will not permit the opening of the relay until the trap door is put back in closed position and the trap door sliding bolt is brought back into locking position.

Of course, it is possible, without going outside the scope of the invention, to conceive of variants and improvements of detail and even to envisage the use of equivalent means.

What is claimed as new and desired to be secured by Letters Patent of the United States is:

1. Protective switch device, provided with at least one pole having contacts that can be separated, comprising:

a box;

a control mechanism that can cause opening and closing of the contacts;

a protective means that can act in case of electrical failure to actuate the control mechanism;

a manual control button;

an electromagnet in the box and linked to the contacts for opening and closing the contacts, the electromagnet being controlled by the control button;

a movable trap door that opens and closes an opening of the box, which opening provides access to a coil of the electromagnet;

a trap door locking element that can be displaced between a closed position in which the locking element immobilizes the trap door to close the opening of the box and an open position in which the trap door can open;

selective blocking means connected between said manual control button and said locking element for immobilizing the locking element in the closed position responsive to the manual control button occupying all positions other than a stop position in which the electromagnet is inoperative, and for freeing the locking element so that the locking element can be brought into the open position in response to the manual control button occupying the stop position.

2. Device according to claim 1, wherein said trap door locking element comprises a sliding bolt that is movable in translation parallel to the direction of movement of the control button and wherein the selective blocking means comprises a blocking slide that prevents any displacement of said sliding bolt when the control button occupies a position other than the stop position and is able to enter the control button when the control button is in the stop position.

3. Device according to claim 2, wherein said control button has a shape that makes possible the displacement of blocking slide when the control button is in the stop position.

4. Device according to claim 1, wherein said trap door locking element comprises a bolt that swings around an axis and that carries said blocking means.

* * * * *